United States Patent [19]

Knoke et al.

[11] Patent Number: 4,490,425

[45] Date of Patent: Dec. 25, 1984

[54] FUSED AND NEEDLED NONWOVEN INTERLINING FABRIC

[75] Inventors: Jürgen Knoke, Weinheim; Manfred Jöst, Hemsbach; Bohuslav Tecl; Erich Fahrbach, both of Weinheim, all of Fed. Rep. of Germany

[73] Assignee: Firma Carl Freudenberg, Weinheim/Bergstrasse, Fed. Rep. of Germany

[21] Appl. No.: 541,881

[22] Filed: Oct. 14, 1983

Related U.S. Application Data

[63] Continuation of Ser. No. 274,378, Jun. 17, 1981, abandoned.

[30] Foreign Application Priority Data

Aug. 28, 1980 [DE] Fed. Rep. of Germany ..... 3032349

[51] Int. Cl.[3] ..... B32B 5/06

[52] U.S. Cl. ..... 428/90; 428/198; 428/200; 428/288; 428/290; 428/296; 428/300; 428/301

[58] Field of Search ..... 428/198, 200, 288, 290, 428/296, 300, 301, 90

[56] References Cited

U.S. PATENT DOCUMENTS 3,829,939 8/1974 Dilo ..... 28/4 R
4,320,167 3/1982 Wishman ..... 428/288

FOREIGN PATENT DOCUMENTS 53-35622 9/1978 Japan ..... 156/148

*Primary Examiner*—Marion E. McCamish
*Attorney, Agent, or Firm*—Kenyon & Kenyon

[57] ABSTRACT

A soft, fluffy, bulky, nonwoven fabric is disclosed which is made from bonded or at least partially fused fibers which have been needle-punctured.

9 Claims, No Drawings

FUSED AND NEEDLED NONWOVEN INTERLINING FABRIC

This is a continuation of application Ser. No. 274,378 filed June 17, 1981, now abandoned.

BACKGROUND OF THE INVENTION

The invention relates to a nonwoven interlining fabric which is soft, fluffy and bulky and can be used with outer textile material. The fabric is made from a web of staple or endless fibers or both, which is bonded by means of bonding or is partially fused by means of thermoplastically softenable bonding fibers and has a pattern of thermal adhesive on one or both surfaces. In the garment industry, nonwoven fabrics, as well as woven and knitted fabrics, have long been used as interlinings. Nonwoven fabrics having thermal adhesive on one or both surfaces can be joined to other fabrics by heat and pressure and have thus found acceptance as interlinings. Spot-fused nonwoven bonded fabrics with thermoplastically softenable fibers are preferred as interlinings when fabric weights between about 30 and 50 g/m$^2$ are required. With heavier spot-fused nonwoven fabrics, insufficient bulk and too stiff a feeling are generally obtained.

Further development of these nonwoven fabrics has included roughening the thermoplastic fiber, spot-fused interlining fabrics as an attempt to create better bulk. This attempt however, has not led to an improvement because the roughening process pulls out the fibers and develops a nap on the nonwoven fabric which cannot be coated with the thermal adhesive. The loosened fibers cover the printing device, and the fabric, which is insufficiently coated with the adhesive, is not resistant to mechanical abrasion.

It is therefore an object of the invention to develop a nonwoven interlining fabric which is particularly suitable for use with soft outer textile material, does not interfere with the properties of the outer material and drapes well. In addition the nonwoven interlining fabric must be resistant to the mechanical abrasion caused by washing and dry-cleaning.

SUMMARY OF THE INVENTION

These and other objects are achieved by the soft, fluffly, bulky, nonwoven fabric of the invention which comprises a nonwoven cloth of binder bonded staple or endless fibers or both or at least partially fused staple or endless fibers or both which at least in part are thermoplastic fibers, the bonded or fused cloth being punctured on one or both sides with 20 to 100 needles per sq. cm. so that a soft, fluffy surface is produced on the side from which the needles emerge, and the cloth being coated on one or both sides with a pattern of thermal adhesive. A preferred fabric has been punctured with from 40 to 65 needles per sq. cm. If the nonwoven fabric is punctured only on one side, the thermal adhesive is preferably printed on or applied to the puncture side.

DETAILED DESCRIPTION OF THE INVENTION

Preferred as working nonwoven fabrics are those made from transversely laid webs of fibers. Longitudinally laid webs of staple or endless fibers or wet-laid webs are also useful for the invention. It is surprising that a nonwoven fabric which is bonded by thermoplastic bonding fibers or binders exhibits the desired fluffy and bulky properties when it is needle-punched according to the invention. This effect is unexpected because typical needle-punched nonwoven fabrics are relatively hard and stiff. These typical needle-punched, nonwoven fabrics are used, for example, as felt bottom linings or as support materials for artificial leather. In contrast, the nonwoven fabric of the invention is needle-punched after bonding or fusing which surprisingly produces a texture, softness and feel opposite to those of the known needle-punched fabrics.

Nonwoven interlining fabrics which may be used as working fabrics are bonded with 5 to 30% binder by weight relative to the weight of the fibers. Such binders include polyacrylester dispersions, polyurethane binders or silicone rubber binders. Additions of 10 to 20% by weight relative to the weight of the fibers are preferred. Alternatively, the working fabrics may be fused by means of thermoplastically softenable bonding fibers. Homofil fibers and preferably bicomponent fibers made from Nylon 6, copolyesters or bicomponent fibers of nylon 66/6 or polyethylene phthalate/copolyesters can be used. The thermoplastic fibers may amount to 10 to 100% by weight of the fiber mixture. Cofibers include conventional, fully synthetic fibers such as polyester, polyamides or polyacryl-nitril fibers. In addition, semisynthetic or natural fibers can be used as cofibers.

The nonwoven interlining fabric of the invention is needle punched with 20 to 100 punctures per sq. cm. on one or both sides after bonding or fusing. The nonwoven fabric can be finished or dyed before or after the needle-punching. For interlining fabrics which are to be joined to outer textiles by cementing and ironing, this finishing operation is performed after the adhesive is applied, preferably on the puncture side, which is not fluffy. Application of the adhesive after puncturing is preferred in order to prevent partial separation of the adhesive and fabric during the needle-punching operation. With interlining materials which do not need to be fixed to outer textiles, it is better to needle-punch on both sides so as to produce a double fluffy fabric.

The interlining materials according to the invention exhibit a soft, fluffy feel and are not adversely affected by dry-cleaning or by washing. These subsequently needle-punched fabrics differ considerably from known interlining materials. They also differ from nonwoven fabrics are are strengthened by entwining the fibers by means of needles before they are bonded. Such entwined nonwoven fabrics are not only uneconomical to produce, they do not exhibit the fluffy and bulky surface of the nonwoven fabric of the invention. While such nonwoven fabrics which have been needle punched before bonding or fusing often show a poorer surface smoothness after ironing and cannot be used for certain applications such as fine blouses, the subsequently needle-punched, nonwoven interlining fabrics of the invention can be used for all such applications because they exhibit surface smoothness.

EXAMPLE 1

Bonded, Punctured Amide-Ester Copolymer Nonwoven Fabric

A fiber mixture of 50% polyamide 6, 1.6 dtex, and 50% by weight polyester 1.7 dtex was carded on a carder and was plaited down on a slat conveyer by means of a transversal laying device. The resulting web was conducted to an impregnating machine and was impregnated there with a foamed mixture of a polymer dispersion of 90% by weight butylacrylate, 6% by weight acrylnitril and 4% by weight N-methylacrylamide, which in addition contained some wetting agent and 1 part by weight "catalyst" maleic acid. The mixture was applied at a rate so that about 5 g/m$^2$ dry substance was taken up. The binder content was about 21% by weight. The width was 1 m and the wind-up velocity was 11 m/min.

This nonwoven fabric was then conducted through an embroidery loom with 2 boards with 5000 needles per meter, each needle being 38 gauge and having 3 barbs per edge (9 barbs per 3 edges). The stroke (frequency) was 1000/min and the depth of penetration was 14 mm. All three barbs per edge pierced the fabric material. The running velocity was about 24 m/min and the number of punctures was 38 per cm$^2$. A material fluffy on one side was produced.

On the smooth, unfluffy surface 12 g/m$^2$ dry weight of a copolyamide thermal adhesive in the form of a dispersion which represented a terpolymer of 25% nylon 6, 25% nylon 66 and 50% nylon 12, was applied by means of screen printing. The thermal adhesive was applied by a 20-mesh screen, dried and sintered-on. This nonwoven fabric was ironed in a platen press at 350 mbar, 150° C. and 10 sec onto an outer material of a polyester-cotton mixture and resulted in a soft, pleasing and, for its light weight, relatively full feel and with good surface smoothness of the top side of the fabric. In addition, it can serve as interlining material that can be ironed-on, for instance, for poplin outer material, outer blouse material and the like.

Measurements of the thickness of the nonwoven fabric with thermal adhesive according to DIN draft 53 855, part 2, yielded 0.42 mm compared to a thickness without subsequent needle punching of 0.30 mm. Measurement of the drapability of the nonwoven fabric laminated with the same outer material according to DIN 54 306 yielded 50.1%.

The low draping coefficient proves a higher degree of drapability and a softer, more textile-like drape than is the case in conventional interlining materials.

EXAMPLE 2

Fused, Punctured Nonwoven Fabric

A fiber mixture of 30% nylon 66 with a strength of 1.7 dtex, 20% polyester with a strength of 3.3 dtex and 50% of a core-sheet bicomponent fiber which consists 50% of nylon 6 and 50% of nylon 66, and the strength of which is likewise 3.3 dtex was carded on a carder and deposited on a slat conveyer by means of a transverse laying device. The resulting web was spot-fused by a calender with a smooth cylinder and an engraved cylinder with dot dimensions of 0.55×0.8×0.65 mm and with 30 dots/cm$^2$ (dot spacing in the horizontal rows 2.1 mm, in the vertical rows 1.6 mm) at a temperature of 225° C. and a pressure of 50 kg/cm. The delivery speed was 10 m/min and the weight of the calendered bonded fabric was 60 g/m$^2$. The width was 1 m.

This nonwoven fabric was subsequently passed through an embroidery loom with 2 boards with 5000 needles per meter, each needle being 40 gauge and having 3 barbs per side (9 barbs per 3 sides). The stroke (frequency) was 1000/min and the depth of penetration was 14 mm; all 3 barbs per side pierced the fabric material. The running velocity was about 24 m/min and the number of punctures per cm$^2$ was 38. A fabric which was fluffy on one side was produced and was very drapable, soft and bulky. On the smooth unfluffy surface, 23 g/m$^2$ of a copolyamide thermal adhesive was applied as a dispersion by means of the screen printing method. The dispersion was a terpolymer of 25% nylon 6, 25% nylon 66 and 50% nylon 12. The thermal adhesive was applied spot-wise, the dot diameter being 0.90 mm and 30 dots being distributed statistically per cm$^2$. The adhesive was subsequently dried and sintered-on. This nonwoven fabric was joined onto an outer material of polyester-cotton 65/35 in a platen press at 350 mbar, 150° C. and 10 sec and provided a very soft, pleasing, full feel.

It can serve as iron-on interlining material for coats, dresses, mens' jackets and the like.

EXAMPLE 3 (Comparison Test)

Fused Nonwoven Fabric

A nonwoven fabric was prepared as in Example 2 but without the subsequent needle-punching procedure of the invention. The fabric produced was harder, flatter and less drapable than the fabric according to Example 2. The fluffy character of the surface was also lacking.

A laminate ironed to the outer material of polyethylene/cotton 65: 35 showed a distinctly flatter and firmer feel than in Example 2.

EXAMPLE 4 (Comparison Test)

Prior and Subsequent Needle-Punching

A nonwoven, unfused fabric of the same composition as in Examples 2 and 3 was prepared by carding, transverse placement and needle-punching. The following conditions were chosen- 2 needle boards (needle-equipped from the top), 6 m/min, 700 strokes, depth of penetration 12 mm. This fabric was then spot-fused under the same conditions as in Example 2, in other words, at 10 m/min in a calender with an engraved and a smooth cylinder at 225° C. It was coated with copolyamide thermal adhesive as in Example 2. The nonwoven fabric material produced in this manner was somewhat less uniform than the fabric produced in accordance with Examples 2 and 3, but its hard and firm feel was similar to the fabric material of Example 3 both before and after the jo to other textiles by ironing. After ironing the fabric of Example 4 to a smooth outer material, the resulting surface was distinctly rougher. The fabrics from three examples which had been ironed to a polyester/cotton woven fabric 65/35, were cleaned three times according to DIN 54 303 Sheet 1 and washed three times according to DIN 54 304 Sheet 1 and 53 920 Section 4.3 (60°). All three fabrics were affected nearly the same with these care treatments. They frayed only little and the laminates had the same feel and softness that they had before washing.

The thickness measurements of the coated material according to DIN draft 53 855 Part 2 showed the following results:

Example 2=1.32 mm; Example 3=1.15 mm; Example 4=1.12 mm.

The drapability of a laminate with the same outer material, measured with the "Cusick tester" according to 54 306 showed:

Example 2: 61.8%; Example 3: 69.4%; Example 4: 72.2%.

A lower draping coefficient showed the softer textile drape and the better drapability.

We claim:

1. A soft, fluffy, bulk, nonwoven fabric which comprises a nonwoven cloth of staple or endless fibers or mixtures thereof, said cloth comprising a mixture of about 10–80% of thermoplastically softenable fibers and the remainder being cofibers, the fibers of said cloth being bound together by the spot fusing of said thermoplastically softenable fibers by heating portions of said cloth to completely fuse said thermoplastically softenable fibers, said cofibers remaining unfused during said heating, said fused nonwoven cloth being punctured on at least on side with from 20–100 barbed needles per square centimeter of said cloth so as to produce a soft, fluffy surface on the side of the said nonwoven cloth from which said barbed needles emerge.

2. The nonwoven fabric according to claim 1 wherein said fused and punctured nonwoven cloth is coated on at least one side with a thermally softenable adhesive.

3. The nonwoven fabric according to claim 1 wherein said fused nonwoven cloth is punctured on one side and wherein a thermally softenable adhesive is applied to the side of said cloth through which said punctures are made.

4. The nonwoven fabric according to claim 1 wherein the thermoplastically fusible fibers of said nonwoven cloth are transversely laid fibers.

5. The nonwoven fabric according to claim 1 wherein said fused nonwoven cloth is punctured with from about 40 to 65 needles per square centimeter.

6. The nonwoven fabric according to claim 1 wherein said fused nonwoven cloth is punctured on both sides.

7. The nonwoven fabric according to claim 1 wherein said nonwoven cloth contains bicomponent fibers.

8. The nonwoven fabric according to claim 7 wherein said thermoplastically fusible fibers are selected from the group consisting of nylon and polyethylene phthalate ester copolymer.

9. The nonwoven fabric according to claim 1 in combination with an outer textile material to which said fabric has been adhesively attached.

* * * * *